US005474812A

United States Patent [19]

Truckenmüller et al.

[11] Patent Number: 5,474,812

[45] Date of Patent: Dec. 12, 1995

[54] METHOD FOR THE APPLICATION OF A LUBRICANT ON A SEWING YARN

[75] Inventors: Kurt Truckenmüller, Heilbronn; Gottlob Wörner, Bönningheim, both of Germany

[73] Assignee: Amann & Sohne GmbH & Co., Bonnigheim, Germany

[21] Appl. No.: 400,474

[22] Filed: Mar. 7, 1995

Related U.S. Application Data

[63] Continuation of Ser. No. 117,032, filed as PCT/DE92/01081, Dec. 18, 1992, publish as WO93/14255, Jul. 22, 1993, abandoned.

[30] Foreign Application Priority Data

Jan. 10, 1992 [DE] Germany ..... 42 00 498.5

[51] Int. Cl.[6] ..... B05D 1/18

[52] U.S. Cl. ..... 427/430.1; 427/369; 427/398.1; 427/434.6; 427/443; 427/443.2

[58] Field of Search ..... 427/430.1, 369, 427/398.1, 443, 443.2, 434.6

[56] References Cited

U.S. PATENT DOCUMENTS

| | | | |
|---|---|---|---|
| 4,451,382 | 5/1984 | Childers | 252/8.6 |
| 4,583,987 | 4/1986 | Kurz | 8/495 |
| 4,737,384 | 4/1988 | Murthy et al. | 427/369 |
| 5,035,921 | 7/1991 | Berneburg et al. | 427/226 |

FOREIGN PATENT DOCUMENTS

| | | |
|---|---|---|
| 0453107 | 10/1991 | European Pat. Off. . |
| 2853066 | 6/1980 | Germany . |
| 3906724 | 9/1990 | Germany . |

*Primary Examiner*—Shrive Beck
*Assistant Examiner*—David M. Maiorana
*Attorney, Agent, or Firm*—Meltzer, Lippe, Goldstein, et al.

[57] ABSTRACT

A method is described for application a lubricant onto a sewing yarn. The sewing yarn to be lubricated is prepared as heap of yarn or as wound package. This heap respectively this package is superfused or perfused with a bath containing said lubricant. As fluid a supercritical fluid is selected. Whereby after the perfusion respectively the superfusion a temperature reduction, a pressure reduction and/or a volume increase is performed.

28 Claims, No Drawings

METHOD FOR THE APPLICATION OF A LUBRICANT ON A SEWING YARN

This is a continuation of application Ser. No. 08/117,032, filed as PCT/DE92/01081, Dec. 18, 1992, publish as WO93/14255, Jul. 22, 1993, now abandoned.

The invention concerns a method for the application of a lubricant on a sewing yarn, with the characteristics of the generic park of claim 1.

Lubricants, which are generally also called preparations or spin finish, accomplish, that a sewing yarn is not damaged during its production and/or at later use due to heat and/or mechanical stress. To prevent such damage of the sewing yarn, a lubricant is applied on the sewing yarn, such that it is distributed more or less homogeneously on its surface.

Due to substrate differences and variable requirements, lubricants can differ in their chemical composition. The most simple case concerns paraffines, solid or fluid fats or waxes. Instead of or in addition to the products mentioned, a lubricant may contain polymeric compounds on the basis of alkylenes, polymeric compounds on the basis of acrylates and/or polymeric silico-organic compounds, in particular silicones. Further to that, lubricants usually contain antistatics, bactericidals and/or emulgators.

For the application of the lubricants described above on a sewing yarn different methods are known.

In case of block lubrication the sewing yarn to be processed is led continuously over the surface of a solid block of lubricant, whereby the contact between the sewing yarn and the lubricant block leads to the transfer of a certain amount of the lubricant from the lubricant block onto the surface of the sewing yarn.

In case of spray lubrication, an aqueous dispersion or emulsion respectively is sprayed on the continuously transported sewing yarn through appropriate nozzle systems.

Further to that the possibility exists, to apply the previously mentioned aqueous emulsion or dispersion of the lubricant in an indirect manner. In such a method the continuously transported sewing yarn is brought into contact with the surface of a dip roller, which dips partly into the respective dispersion or emulsion. Another possibility provides to lead the sewing yarn through a respective aqueous emulsion or aqueous dispersion of the lubricant, and subsequently remove the excess lubricant by pressing, centrifuging or scraping.

In case of lubrication from a bath the sewing yarn to be processed is initially prepared as a heap of yarn, in particular as a wound package. This heap of yarn respectively wound package is then introduced into a conventional dyeing device and perfused or superfused for a predetermined period of time with an aqueous dispersion or an aqueous emulsion of the lubricant. At the end of this time period the emulsion or the dispersion of the lubricant is destroyed by a change in temperature or pH value, leading to a deposition of the lubricant on the surface of the sewing yarn.

The above described known methods for the lubrication of a sewing yarn possess as main disadvantage, that there is no guarantee, that the coating with the lubricant is always of homogeneous thickness. This is due to the fact, that at the block lubrication only a part of the radial outer surface of the sewing yarn gets into contact with the lubricant block, whereas in the other mentioned methods the relative instability of the aqueous dispersions or aqueous emulsions, due to the bad solubility of the lubricants in water, makes them highly sensitive to changes in temperature and/or pH variations, and may fairly quickly cause the destruction of such dispersions or emulsions, explaining the unhomogeneous application of the lubricant. Furthermore in lubricating from a bath filtration phenomena may occur, which lead to unwanted filtration off on inner or outer layers depending on the perfusion direction of the heap of yarn respectively the wound package, which lead to an extremely unhomogeneous lubricant application over the geometry of the heap of yarn respectively the wound package.

It is the object of the present invention to provide a method of the indicated nature which allows a particularly homogeneous application of the lubricant on the surface of the sewing yarn. This object is solved by a method with the characteristic features of claim 1.

In the inventive method for the application of a lubricant on a sewing yarn, the sewing yarn is initially processed to a heap of yarn, in particular a wound package. Subsequently the heap of yarn respectively the wound package is perfused respectively superfused with the lubricant-containing fluid, this fluid being in a supercritical slate. At the end of a predetermined period of time a reduction in temperature, a reduction in pressure and/or a volume increase is performed, leading to the deposition of the lubricant on the surface and/or partially on the inside (fibre respectively filament gaps) of the sewing yarn.

The expression supercritical fluid in the frame of the present invention means such a fluid, where the pressure and/or the temperature lie above the characteristic critical values for this particular fluid and/or the volume above the critical volume. Such a supercritical fluid is therefore above the critical point, which is a specific value for each particular fluid.

It could surprisingly be shown by the inventive method, that the conventional lubricants, which are insoluble in water and can only with difficulty be processed Lo emulsions or dispersions, which emulsions and dispersions are moreover unstable, are completely or nearly completely soluble in a supercritical fluid or can be processed to stable dispersions or emulsions. Therefore the inventive method makes it possible to perfuse or superfuse the heap of yarn respectively the wound package with a stable system, consisting of a solution, a dispersion or an emulsion of the lubricant in a supercritical fluid. This prevents, that the inventive method is accompanied by unwanted and uncontrolled destruction of the emulsion or the dispersion, which then would lead to an unhomogeneous distribution of the lubricant on the sewing yarn, as is the case according to the state of the art. This explains, that the inventive method allows a reproducible application of evenly distributed lubricant layers.

The inventive method possesses further advantages. Since the inventive method provides the use of a solution or a stable emulsion or dispersion in the supercritical fluid, this means that the heap of yarn respectively the wound package of the sewing yarn is in its entire magnitude always uniformly wetted with the lubricant-containing fluid, providing a homogeneous amount of lubricant on the sewing yarn over its entire length and diameter. In other words, the inventive method excludes the occurrence of unhomogeneously lubricated sewing yarns, which explains why the sewing yarn treated according to the inventive method shows a significantly lower breaking frequency than is shown by sewing yarn treated according to the state of the art. Furthermore the sewing yarn treated according to the inventive method does not show any wear of the lubricant by direct contact with yarn guides, as is frequently the case with such a sewing thread prepared according to the state of the art. Furthermore the inventive method is particularly non-polluting, since no waste water contaminated with lubricant remainder is produced. A reduction in temperature, a reduction in pressure and/or a volume increase cause a conversion of the supercritical fluid into the respective gas or into the respective fluid, the lubricant at the same time being converted into the pure product, which can be separated from the gas or fluid used by simple methods, for instance by filtration or absorption. The gas respectively the fluid which is so formed, may be caught up practically without any loss and can be used again. Another possibility is, to collect the supercritical and lubricant-containing fluid in a separate container, thus enabling another lubrication procedure. The use of the inventive method also makes a drying procedure of the lubricated material unnecessary, it being sufficient to change the temperature, the pressure and/or the volume of the particular supercritical fluid to such an extent, that the supercritical fluid is converted into its gas phase.

A further, highly relevant advantage of the inventive method is the fact that the lubricant-containing supercritical fluid, due to its gas-like viscosity in the supercritical state, can perfuse the heap of yarn respectively the wound package with substantially higher speed and with significantly lower pressure differences, whereas the conventional method, in which aqueous systems are used, requires, at a comparable density of the heap of yarn respectively the wound package, markedly higher pressure differences at worse and less uniform perfusion properties. This is another important reason, why according to the inventive method the lubricants are deposed particularly uniformly onto the sewing yarn. Besides, the above-mentioned improved theological properties are time reason, why the inventive method makes it possible to work at a markedly lower bath ratio compared to the conventional method, making the inventive method economically particularly attractive.

According to a first embodiment of the present invention, the lubricant is initially dissolved in the critical fluid, the fluid flows for a predetermined period of time through the heap of yarn respectively the wound package and thereafter the pressure of the fluid is reduced. Hereby it is accomplished, that as has been described previously, the lubricant is bound to the surface of the sewing yarn, whereas the pressure reduction, which is best obtained by a respective volume increase, converts the fluid into the respective gas. The lubricant which has not been bound to the sewing yarn is converted into the respective pure product, which may in the above-described simple manner be separated from the fluid (by then present in its gas form).

The time necessary for the pressure reduction of the fluid in this embodiment, depends on the mass of the sewing yarn to be lubricated and for that mather on the dimension of the respective machinery. In machines with a filling volume of 200 1, the time necessary for the pressure reduction varies between appr. 0.2 and appr. 4 seconds. In machines with a filling volume of up to 1000 1, the same time period varies between appr. 4 and appr. 10 seconds, whilst in machines with a filling volume between about 1000 and 2000 1 the time period varies between appr. 10 and appr. 30 seconds.

The pressure reduction described above can be performed in different steps or preferably in one step. in particular in the abrupt pressure reduction, which as previously mentioned, can in the most simple manner be obtained by an increase in volume, the supercritical fluid used is converted within parts of seconds to maximally a few seconds in its respective gas, so ensuring a particularly uniform distribution of the lubricant on the sewing yarn.

The temperature chosen at the inventive method for the lubrication, is dependent on the ability of the lubricant to generate a dispersion, an emulsion and/or a solution in the respective selected supercritical fluid and the pressure of the supercritical fluid. As a rule it can be said, that the inventive method is performed at a temperature between 10° C. and 290° C., preferably between 28° C. and 180° C. Accordingly the pressure selected at the inventive method varies between 20 bar and 280 bar.

In general the selection of the supercritical fluid used at the inventive method depends on the ability of the selected lubricant to generate a dispersion, an emulsion or a solution in the supercritical fluid. It is however preferred to use such a supercritical fluid, which is supercritical at relatively low pressures and temperatures. Possible candidates are in particular carbon dioxide, which is supercritical at a temperature above 31° C. and a pressure above 73 bar, ethane, which is supercritical at a temperature above 32° C. and a pressure above 48 bar, n-propane, which is supercritical at a temperature above 96° C. and a pressure above 42 bar, n-butane, which is supercritical at a temperature above 152° C. and a pressure above 37,5 bar, n-pentane, which is supercritical at a temperature above 196° C. and a pressure above 33 bar, n-hexane, which is supercritical at a temperature above 234° C. and a pressure above 29 bar, chlorotrifluoromethane, which is supercritical at a temperature above 28° C. and a pressure above 71 bar and nitrogen oxide, which is supercritical at a temperature above 36° C. and a pressure above 71 bar, all fluids to be used single or in combination. It could be observed, that the mentioned fluids possess excellent properties for the generation of dispersions, emulsions or solutions with a number of usual lubricants.

According to a further embodiment of the inventive method, a moderator is added to the fluid or the fluid mixture, in order to change the properties of the fluid or the fluid mixture, in particular the solubility for lubricants. In the most simple case it concerns polar substances, like for instance aqueous acids, aqueous bases or water. Furthermore such moderators are particularly suited, which are untoxic and which evaporate at a pressure reduction, a volume increase and/or a reduction in temperature together with the fluid or the fluid mixture, which has by then lost its supercritical slate. For this purpose lower alcohols, like methanol, ethanol and/or propanol, can be used. In addition such moderators can be used which lead to a swelling of the surface of the sewing yarn, in order to achieve, that the applied lubricant is bound chemically or physically to the surface of the sewing yarn. It concerns such moderators, which are usually used during the dyetng of such sewing yarns and which swell the yarn substrate.

The concentration of the moderator added to the fluid depends on the one hand on the lubricant used and on the other hand on the respective fluid used. Usually the concentration varies between appr. 1% by weight and appr. 15% by weight, preferably between appr. 5% by weight and 10% by weight, in all cases relative to the amount of fluid.

It is possible at the inventive method to obtain particularly good properties concerning the behavior at the production and/or the processing of the lubricated sewing yarn, when a lubricant is used which is composed on the basis of oils, of fats, of waxes, of polyalkylenes and/or of silicoorganic compounds, in particular silicone. Such a lubricant may be present as a one-compound lubricant or preferably contain more than one of the mentioned compounds or all of them, whereby in the latter case the lubricant mixture used at the inventive method contains preferably 15% by weight to 25% by weight fat, waxes and/or oils, 5% by weight to 20% by weight polyalkylene, in particular polyethylene, and 30% by weight to 45% by weight silicon oil, as well as the usual additional products, like for instance bactertcidals, antistatics, a covering preparation and/or water. Such a mixture of lubricants is preferably used with the previously mentioned supercritical fluids, in particular with ethane, propane, butane, penfane and/or carbon dioxide, in which good solutions, dispersions or emulsions can be made.

According to a further, particularly suitable embodiment of the inventive method, the lubricant and/or a component of the lubricant is applied on the sewing yarn layer by layer. This makes it for instance possible, at the above-mentioned lubrication to begin by applying a layer of polyalkylene lubricant on the surface, in particular a layer of polyethylene lubricant, followed by a layer of oil-, fat- and/or wax-lubricant and subsequently cover this second layer with a silicone layer (3rd layer). Such a layer-wise applied lubrication adheres particularly well to the surface of the sewing yarn, as is demonstrated by correspondingly good processing- and use properties, like for instance little abrasion and a low breaking frequency.

To make the previously mentioned layer-wise application of the lubricant possible, a further embodiment of the inventive method comprises, that the first-layer lubricant or the first-layer lubricant component is dissolved in a first step at a predetermined pressure and/or a predetermined temperature in a first fluid and the heap of yarn respectively the wound package is superfused with this fluid in supercritical state and preferably perfused. Subsequently the pressure and/or the temperature of the first fluid is changed, preferably by reduction, which leads to a lowering in the solubility of this first-layer lubricant or this first-layer lubricant component, thereby generating time first layer of the lubricant or the lubricant component on the sewing yarn. Thereafter in a second step time further lubricant or lubricant component is dissolved in the first fluid and/or an other fluid and the heap of yarn respectively the wound package is perfused with this second solution. By a change in pressure and/or temperature this second layer is deposed on top of the first layer already present on the surface of the seeing yarn. Good care should be taken, that the fluid used in the second step does not dissolve the already deposed first layer of the lubricant. This may be achieved, by using the first fluid under different pressure and/or temperature conditions, or a different fluid which does not dissolve the first lubricant layer.

Preferably the before-described variant of the method is repeated until between two and six layers of the lubricant or the lubricant components have been deposed on the sewing yarn.

According to a particularly suited embodiment of the inventive method a covering preparation is added to a fluid (to constitute an emulsion, a dispersion or a solution) and the heap of yarn respectively the wound package is perfused respectively superfused with this solution, dispersion respectively emulsion in supercritical slate before the application of the lubricant. By so doing it is achieved that the covering preparation, which is preferably soluble in the respective fluid, is deposed in the capillary gaps of the sewing yarn. This is especially the case, when the sewing yarn possesses a relatively open structure, as is the case in sewing yarn produced according to an air intermingling process. At the end of the predetermined period of time a temperature- and/or pressure-reduction and/or a volume-increase is performed, converting the supercritical fluid to the respective gas or the respective fluid, which is not able to dissolve the covering preparation. After this preparation the lubricant is applied in the manner described above. Such a method has the advantage that a sewing yarn lubricated in this manner possesses besides an excellent cover very good properties for further processing and in use, illustrated by a correspondingly low breaking frequency and particularly high sewing performance.

In general for the above-described method each covering preparation can be used which warrants a sticking-together of the capillaries. Particularly suited are the use of covering preparations on the basis of an organic polymeric compound, in particular on the basis of a polyalkylene, a polyacrylate and/or a polyvinyl alcohol.

The amount applied of the covering preparation depends on the structure of the sewing yarn to be treated. Usually it varies between 5% by weight and 10% by weight, relative to the mass of the sewing yarn to be treated.

The amount applied of the lubricant used in the inventive method depends on the construction of the respectively sewing yarn and the stress intensity during processing and use. Normally it is between 0.5 and 15% by weight relative to the mass of sewing yarn.

The inventive method is performed at a bath ratio of 1:1 to 1:20, preferably at a bath ratio between 1:2 and 1:5.

The inventive method can basically be used in any sewing yarn. It is however particularly advantageous, when a synthetic sewing yarn is being used, in particular sewing yarns which contain polyamide6-, polyamide6.6-, polyester-, (polyethylenetherephtalate), aromatic polyamide-, polypropylene-, Nomex-, glass-, polyacrylnitril-, carbon fibres and/or ceramic fibres. The inventive method can always be applied excellently, when a polyester sewing yarn or a polyester containing sewing yarn are being lubricated. In the mentioned sewing yarns it concerns Core-yarns, multifilament-yarns or filament/fibre-yarns, which may be twisted.

Furthermore the afore-mentioned sewing yarns may show the construction of an air-intermingled core jacket yarn or a spunover yarn. The titre of the mentioned sewing yarns varies in the range between. 50 dtex ×2 (total titre 100 dtex) and 1200 dLex ×3 (total titre 3600 dtex).

It is a major advantage of the inventive method, that the inventive method, based on the fact that it warrants a particularly high uniformity of the applied layers of lubricant, markedly gives the sewing yarn produced according to this method a lower slip resistance, which makes the improvement in the processing- and use-properties quite understandable. These improvements can be shown according to the sewing properties, as is be demonstrated by the following two examples.

The following examples illustrate the invention.

EXAMPLE 1.

A polyester sewing yarn Nm 25/2 was prepared as a cross-wound package (1 kg) and was treated in a conventionally built dyeing device at a bath ratio of 1:25 with the following lubricant-emulsion respectively -dispersion:

Composition of the lubricant emulsion/dispersion:

30% by weight pararline (melting point 45°–55° C.)

25% by weight polyethylene (molecular weight 8000–10000)

40% by weight silicon oil (viscosity 35,000 cSt)

5% by weight emulgator and antistatic.

40% by weight of the lubricant mixture were dispersed respectively emulsified in 1 l water. Of this emulsion respectively dispersion 5 l were added to 20 l of bath fluid, so that the polyester sewing yarn was perfused with the lubricant-containing bath at a bath ratio of 1:25.

The lubricant-containing bath was heated with a beating rate of 2° C./min from 20° C. to 60° C. Subsequently the lubricant-containing bath fluid perfused the cross-wound package for 15 min. Hereafter the lubricant-containing bath was cooled from 60° C. to 30° C., with a cooling rate of 3° C./min, which destroyed the dispersion respectively emulsion, due to the rapid cooling.

The bobbin treated in this way was dried at 100° C.

Thread samples were taken from the inner zone of the cross-wound package, the middle zone of the cross-wound package and the outer zone of the cross-wound package.

These samples were extracted with petroleum ether for 4 hours in a Soxhlet extractor. The result of the extraction is depicted in the following table.

TABLE 1

| sample | extracted part (in % by weight of total mass) |
|---|---|
| inner sample | 7.6 |
| middle sample | 5.8 |
| outer sample | 4.9 |

The perfusion at the application of the lubricant had been performed from inside to outside, which makes the increased value for the sample from the inner zone (7.6%) understandable.

The so lubricated sewing yarn was evaluated according to a standard procedure on its sewing properties. The results of this evaluation have been depicted in table 2.

TABLE 2

| sample | number of buttonholes without breakage | length of yarn until breakage at 7000 stitches/min |
|---|---|---|
| inner | 180 ± 5 | 1200 meters |
| middle | 160 ± 5 | 1000 meters |
| outer | 135 ± 6 | 1000 meters |

EXAMPLE 2.

The same sewing yarn as described in Example 1 was prepared in the same way (package) and lubricated in a high-pressure laboratory device.

The lubricant had the following composition:

30% by weight paraffin (melting point 45°–55° C.)

25% by weight polyethylene (molecular weight 8000–10000)

40% by weight silicon oil (viscosity 35000 cSt)

5% by weight antistatic.

150 g of the lubricant mixture was dissolved in n-propane, which had been heated to a temperature of 110° C. and showed a pressure of 50 bar. Hereafter the supercritical propane was perfused for 3 min through the wound package. The direction of the perfusion was from the inside to the outside like in Example 1.

The bath ratio was 1:3.

After the period mentioned the pressure was rapidly decreased to normal. The propane gas which evolved was caught.

From the bobbin samples were taken from the inner zone, the middle zone and the outer zone. These samples were extracted as in Example 1.

The result of the extraction is depicted in the following Table 3.

TABLE 3

| Sample | extracted part (in % of total mass) |
|---|---|
| inner sample | 4.9 |
| middle sample | 5.0 |
| outer sample | 5.0 |

The sewing properties of the material treated as described in this example were estimated in the same manner as in Example 1. The following values, depicted in Table 4, were obtained.

TABLE 4

| Sample | number of buttonholes without breakage | length of yarn until breakage at 7000 stitches/min |
|---|---|---|
| inner | 210 ± 2 | after 1500 meters no breakage, test discontued |
| middle | 209 ± 2 | after 1500 meters no breakage, test discontinued |
| outer | 209 ± 2 | after 1500 meters no breakage, test discontinued |

The values depicted in the tables 2 and 4 are mean values of 50 estimations. Accordingly it is clearly observable, that the sewing yarn treated according to Example 2 is markedly superior in its sewing properties compared with the sewing yarn treated according to Example 1.

A dyeing experiment with a paraffin-marked dye (sudan red) proved, that the sewing yarn lubricated according to the method of Example 2 showed a markedly better and more uniform distribution of the lubricant at its surface than the sewing yarn, which had been treated according to the standard procedure using an aqueous system (Example 1).

Package winding under normal working conditions proved, that the sewing yarn according to Example 2 caused no abrasion on the yarn heading means, in contrast to the sewing yarn prepared according to the aqueous system (Example 1 ), where respective abrasion of lubricant and yarn particles was observed.

We claim:

1. A method for applying a lubricant to the surface of a sewing yarn which has been prepared into a heap, comprising:

bringing a fluid containing said lubricant into contact with said sewing yarn by perfusion or superfusion for a period of time, wherein said fluid is a supercritical fluid, and thereafter performing a temperature reduction, a pressure reduction, or a volume increase thereby causing said lubricant to be deposited on the surface of said sewing yarn, wherein said fluid further contains a covering preparation which is deposited in capillary gaps of said sewing yarn and causes adhesion of capillaries in said yarn.

2. The method of claim 1 wherein said heap of yarn has been prepared as a wound package.

3. The method of claim 1 wherein said lubricant is dissolved in said supercritical fluid, wherein, said fluid is brought into contact with said heap of yarn by perfusion, and wherein a pressure reduction is performed after said period of time.

4. The method of claim 1 wherein said period of time is between 30 seconds and 20 minutes.

5. The method of claim 1 wherein said period of time is between 2 minutes and 10 minutes.

6. The method of claim 1 wherein said fluid is brought into contact with said heap of yarn at a fluid temperature between 10° C. and 290° C.

7. The method of claim 1 wherein said fluid is brought into contact with said heap of yarn at a fluid temperature between 28° C. and 180° C.

8. The method of claim 1 wherein said fluid is brought into contact with said heap of yarn at a fluid pressure between 20 bar and 280 bar.

9. The method of claim 1 wherein said supercritical fluid is selected from the group consisting of alkanes, nitrogen oxide, trichlorfluoromethane, carbon dioxide, and mixtures thereof.

10. The method of claim 9 wherein said supercritical fluid is selected from the group consisting of ethane, propane, butane, pentane, and mixtures thereof.

11. The method of claim 1 wherein said fluid further contains a moderator which affects the properties of said fluid.

12. The method of claim 11 wherein said moderator affects the solubility of said lubricant in said fluid.

13. The method of claim 1 wherein said lubricant is selected from the group consisting of oils, fats, waxes, polyalkylenes, silico-organic compounds, and mixtures thereof.

14. The method of claim 13 wherein said lubricant comprises 15% –25% by weight of fats, waxes, oils, or mixtures thereof, 5% –20% by weight of a polyalkylene, and 30% –45% by weight of silicone oil.

15. The method of claim 13 wherein said polyakylenes comprise polyethylene.

16. The method of claim 1 wherein multiple layers of said lubricant or lubricant components are applied to said sewing yarn by repeating said steps of claim 1.

17. The method of claim 16 wherein 2 to 6 layers of said lubricant or lubricant components are applied to said sewing yarn.

18. The method of claim 1 wherein said covering preparation is an organic polymer.

19. The method of claim 18 wherein said polymer is selected from the group consisting of a polyalkylene, a polyacrylate, a polyvinylalcohol, and mixtures thereof.

20. The method of claim 1 wherein said covering preparation is applied to said sewing yarn at a concentration of 0.5% to 15% by weight relative to the mass of said sewing yarn.

21. The method of claim 1 wherein said lubricant is applied to said sewing yarn at a concentration of 0.5% to 15% by weight relative to the mass of said sewing yarn.

22. The method of claim 1 wherein said fluid is brought into contact with said sewing yarn at a volume ratio of fluid to sewing yarn between 1:1 to 20:1.

23. The method of claim 22 wherein said volume ratio is in the range between 2:1 to 5:1.

24. The method of claim 1 wherein said sewing yarn is made from a material consisting of polyamide 6-, polyamide 6.6-, polyester, aromatic polyamide fibers, and mixtures thereof.

25. The method of claim 1 wherein said sewing yarn is made from a material consisting of fibers, filament yarns, or mixtures thereof and having a total titre between 100 dtex and 3600 dtex.

26. The method of claim 22 wherein said sewing yarn is selected from the group consisting of a sewing thread, a core yarn, a spun-over sewing yarn, or an air intermingled sewing yarn.

27. A method for applying a lubricant to the surface of a sewing yarn comprising wetting the surface of said sewing yam with a fluid containing said lubricant, wherein said fluid is a supercritical fluid, and thereafter performing a temperature reduction, a pressure reduction, or a volume increase, thereby causing said lubricant to be deposited on the surface of said yarn, wherein said fluid further contains a covering preparation which is deposited in capillary gaps of said sewing yarn and causes adhesion of capillaries in said yarn.

28. The method of claim 27 further comprising removing said fluid from the surface of said sewing yarn while leaving said lubricant deposited on the surface of said sewing yarn.

* * * * *